US005657781A

United States Patent [19]

Steverson

[11] Patent Number: 5,657,781

[45] Date of Patent: Aug. 19, 1997

[54] MACHINE FOR CLEANING ROLLERS IN PAPER PRODUCING MACHINES IN SITU

[75] Inventor: Joseph H. Steverson, deceased, late of New Hebron, Miss., by Jill Steverson, administratrix

[73] Assignee: Circle S, Inc., New Hebron, Miss.

[21] Appl. No.: 541,404

[22] Filed: Oct. 10, 1995

[51] Int. Cl.[6] ..... B08B 3/02; B05B 13/04

[52] U.S. Cl. ..... 134/144; 134/172; 239/160; 239/165; 239/172

[58] Field of Search ..... 134/144, 172; 239/160, 165, 172

[56] References Cited

U.S. PATENT DOCUMENTS

| | | | |
|---|---|---|---|
| 751,612 | 2/1904 | Case | 239/165 |
| 1,370,252 | 3/1921 | Williams | 239/165 X |
| 2,064,278 | 12/1936 | Tappe | 139/165 |
| 2,259,966 | 10/1941 | Tappe | 239/165 X |
| 3,957,203 | 5/1976 | Bullard | 239/165 X |
| 4,201,342 | 5/1980 | Stram | 239/128 |
| 4,673,130 | 6/1987 | Simpson | 239/172 X |
| 4,760,857 | 8/1988 | Shiba et al. | 134/144 |
| 4,856,545 | 8/1989 | Krajicek et al. | 134/166 C |
| 5,004,156 | 4/1991 | Montanier | 239/130 |
| 5,018,544 | 5/1991 | Boisture et al. | 134/144 X |
| 5,368,232 | 11/1994 | Schroeder | 239/172 X |

FOREIGN PATENT DOCUMENTS

| | | |
|---|---|---|
| 61154 | 4/1968 | Germany . |
| 2209453 | 9/1973 | Germany . |

*Primary Examiner*—Philip R. Coe

[57] ABSTRACT

A device for cleaning rollers in paper producing machines such as those used to calendar paper in the process of manufacturing paper from pulp. The device cleans rollers in paper producing machines with a high pressure hydrospray, while the rollers remain in the machine, thus, eliminating the need to remove the rollers from the machine in order to clean them.

11 Claims, 3 Drawing Sheets

MACHINE FOR CLEANING ROLLERS IN PAPER PRODUCING MACHINES IN SITU

BACKGROUND OF THE INVENTION

1. Field of the Invention

The present invention relates to a device for cleaning rollers in paper manufacturing machines. More particularly, present invention relates to a device for cleaning rollers in paper manufacturing machines such as those used to calendar paper in the process of making paper from pulp. Even more particularly, the present invention relates to a device for cleaning rollers in paper producing machines with a high pressure hydrospray, while the rollers remain in the machine, thus, eliminating the need to remove the rolls in order to clean them.

2. General Background

Prior to the instant invention, in order to clean the rollers of paper producing machines, such as the type used to calendar paper in the process of manufacturing paper from pulp, it was necessary to first remove the rollers from the machines in order to clean the rollers.

In the past, paper mill rollers could only be cleaned by the time consuming, tedious and difficult process of physically disassembling the machine and removing the rollers prior to cleaning because a high pressure spray is required to clean the rollers, and prior to the instant invention, it was not possible to direct a high pressure spray into the machine to clean the rollers in situ.

It was previously impossible to clean the rollers in situ because the location of the rollers within the machine made it physically impossible to effectively clean the rollers with existing cleaning technology. This problem existed prior to the instant invention because, (i) in order to effectively clean the rollers it is necessary to deliver a high pressure spray that directly impinges upon the entire outer surface of the rollers, however, (ii) when the rollers are located within the machine, the geometry of the outer surface of the rollers relative to the point of access to the rollers made it impossible for existing cleaning technology to effectively clean the roller surface.

When the rollers are within the machine, they extend deep into the machine, with their outer surfaces running parallel to one another, yet extending perpendicularly away from the point of access to the rollers within the machine. Thus, in order to clean the rollers within the machine, it is necessary to both (i) deliver a high pressure spray that can reach deep within the machine and (ii) deliver a high pressure spray that can directly impinge upon the entire outer surface of the rollers.

Prior to the instant invention it was impossible to effectively clean rollers in situ in paper manufacturing machines because it was not possible to provide a high pressure spray that could both reach deep within a machine and directly impinge upon the entire outer surface of a roller. In order to perform such a function, it would be necessary to, as the instant invention does, provide a high pressure spray at, for example, the end of an extendable boom, where such a spray is directed substantially at a right angle from the axis of the boom, such that the spray can directly impinge upon the entire length of the outer surface a roller as the boom extends deep within the machine.

Prior to the instant invention it was not possible to effectively clean rollers in situ by the method of the instant invention because, inter alia, it was not possible in the existing art to both (i) provide a high pressure spray at the end of an extendable boom and (ii) direct such a spray at a net, approximately right angle to the axis of the boom.

The prior art does not disclose, or suggest, an apparatus wherein a high pressure spray is provided at the end of an extendable boom and where the high pressure spray is directed at a net, approximately right angle to the axis of the boom. In order to perform such a function, as does the instant invention, it would be necessary for the boom to not only extend and provide a high pressure spray from its end, but also it would be necessary for the boom to resist the high side thrust that would be created by the direction of a high pressure spray at a net angle away from the axis of the boom.

The prior art reveals only the provision of low pressure spray along a boom, where no significant side thrust would be created and where the apparatus clearly could not withstand a high side thrust against the axis of the boom, or, reveals the provision of spray along a boom where the pressure produced by the spray nozzles is balanced such that there is no net force produced against the axis of the boom.

To wit, U.S. Pat. No. 4,856,545 to Krajicek and to others discloses a mobile, truck supported tube cleaning apparatus which uses a high pressure water stream for cleaning tubes. The original application was for pressures which could be applied by a hand held cleaning lance, and therefore the side thrust was limited. The invention shows a truck mounted cleaning lance which is offset on a swinging boom, however, the boom does not show stability against side loads.

U.S. Pat. No. 4,760,857 to Shiba and others shows a roller cleaner for a printing press, which comprises a permanently installed piping and spray system for applying a washing solvent (described as an oil solvent: Kerosine, etc.) evenly to the roller surfaces. The spray nozzles are reciprocated to provide a more even spray. There is no boom to direct the spray into a specific location, such as inside a machine.

U.S. Pat. No. 751,612 to Case describes a tuck or cart mounted water sprinkler. This invention includes extending sprinkler pipes which are extended to the side of the truck by a rack and gear mechanism, including means to prevent the spray pipe from turning from its designed direction. However, the force, and thrust, of the spray from these pipes is necessarily limited by the application of the machine, the device being merely a low pressure sprinkler for roadways.

U.S. Pat. No. 2,064,278 to Tappe shows and extending, vehicle mounted spray boom for extinguishing fires. Here, the extended spray boom is not designed to withstand side forces from side spray, as the device only sprays forward from the end of the boom. Further, this device is not related to the use of high pressure spray to clean objects such as rollers.

U.S. Pat. No. 4,201,342 to Stram shows a device for spray repair of interior furnace walls which shows an extendable spray lance which is mounted on the end of a truck mounted boom. The lance is protected from heat, but is clearly not braced for significant side loads from side spray pressures. In addition, the device is not related to the use of high pressure spray to clean objects such as rollers.

U.S. Pat. No. 5,004,156 to Montainer shows a truck mounted rotary pressure water spray for washing surfaces such as roadways and the like. In one embodiment, the rotary jets are mounted to a boom arm which is freely moveable against a surface to be cleaned. However, the described spray pressure is low, and the spray is through relatively small nozzles, balanced at the ends of a rotary arm so that there is no net side force on the arm. The small nozzles are stated to limit consumption of hot water in washing and the boom is not designed to withstand side thrusts.

Hence, the prior art does not show the provision of a high pressure spray at the end of an extendable boom wherein there is a net direction of the spray produced away from the axis of the boom.

SUMMARY OF THE PRESENT INVENTION

It is a principal object of the present invention to overcome the limitations imposed by the prior art and provide a machine capable of cleaning rollers in situ in paper producing machines. It is a principal object of the present invention to provide an extendible arm, extending from a movable and stablizable base, capable of accepting side spray loads. The boom is extendable into a paper producing machine where it can direct a high pressure cleaning spray directly upon the face of the rollers, the high pressure spray being directed perpendicular to the axis of the boom, and the boom being supported to accept the side load.

Further, the boom is extendable and retractable so that it can be slowly inserted into a paper producing machine along the face of a roller, where the directionally pointed spray will wash the entire length of the roller.

Further still, it is a principal object of the instant invention to further provide a separately positionable gear box drive designed to engage with the roller turning mechanism of the paper producing machine, such that the rollers can be slowly turned while the boom is traversing the length of the rollers. In combination, with the roller turning gear box drive slowly rotating the rollers, and the boom slowing extending and contracting along the length of the roller, the entire surface of the roller can be cleaned without the need to remove the roller from the machine.

More particularly, it is a principal object of the present invention to provide a roller cleaning machine for cleaning paper producing machine rollers, while such rollers are in place within the paper producing machine, where a mobile, positionable and stablizable lower base is positionable relative to the point of access, on a paper producing machine, to the rollers within a paper producing machine. Further, a pivotable upper base, supported by the lower base is also provided that is pivotable with respect to the lower base and is pivotable and adjustable relative to the point of access, on the machine, to the rollers within the paper producing machine.

Further, an outwardly extending boom, attached to, and pivotable with the upper base is provided that is extendable outward from and retractable to the upper base. This boom is extendable into a paper producing machine from the point of access to the rollers within the machine and is extendable and retractable along the entire length of the rollers within a paper producing machine, thereby being capable of spray cleaning the entire length of the rollers within a paper producing machine.

A further principal object of the present invention is to provide, positioned near the distal end of the boom, a hydronozzle which is positioned, and may be positionable and adjustable, to provide a high-pressure spray directed away from the boom at about a right angle to the axis of the boom; the high pressure spray directed to directly impinge upon the outer surface of the rollers in order to clean the rollers in situ.

Further, it is a principal object of the present invention to provide a super-high pressure spray at the end of the extendable boom in order to fully clean the rollers. Such a super-high pressure spray can be provided at the end of the extendable boom by, for example, generating super-high pressure with a separate spray-producing unit; the separate unit producing the high-pressure spray being connected by tubing to the hydroblaster nozzles at the end of the extendable boom. A separate high-pressure spray producing unit such as a diesel powered hydroblaster could be used to provide the high pressure spray at the end of the extendable boom.

Further still, it is a principal object of the present invention provide support for the boom against both vertical force and horizontal forces. Still further, it is a principal object of the instant invention to provide an extendable boom that provides, at its end, a sidewardly directed high pressure spray wherein the boom is supported to resist net forces produced by the angularly directed high pressure side spray.

In addition, it is a principal object of the present invention to provide a second unit, to work in combination with the above-described machine, wherein the second unit provides a means to turn the rollers, in situ, while they are being sprayed by the above described machine. A principal object of the present invention is to provide, for the second unit, a gear box drive which is positionable and stablizable relative to the gears of a paper producing machine, where the gear box drive is engagable with the gears of a paper producing machine; the gear box drive being engagable with the gears of a paper producing machine such that the gear box drive can slowly turn the rollers of a paper producing machine; the gear box drive unit can be driven by a separate motor unit, such as a separate hydraulic or electric motor.

Thereby, with the concert of the machine and the gear box drive unit working together, it is a principal object of the present invention to provide a means to clean the entire outer surface of a roller in situ; the extendable arm slowly traversing the length of the roller and the roller slowly turning at the same time, thereby washing the entire outer surface of a roller while the roller remains in situ, within the machine.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
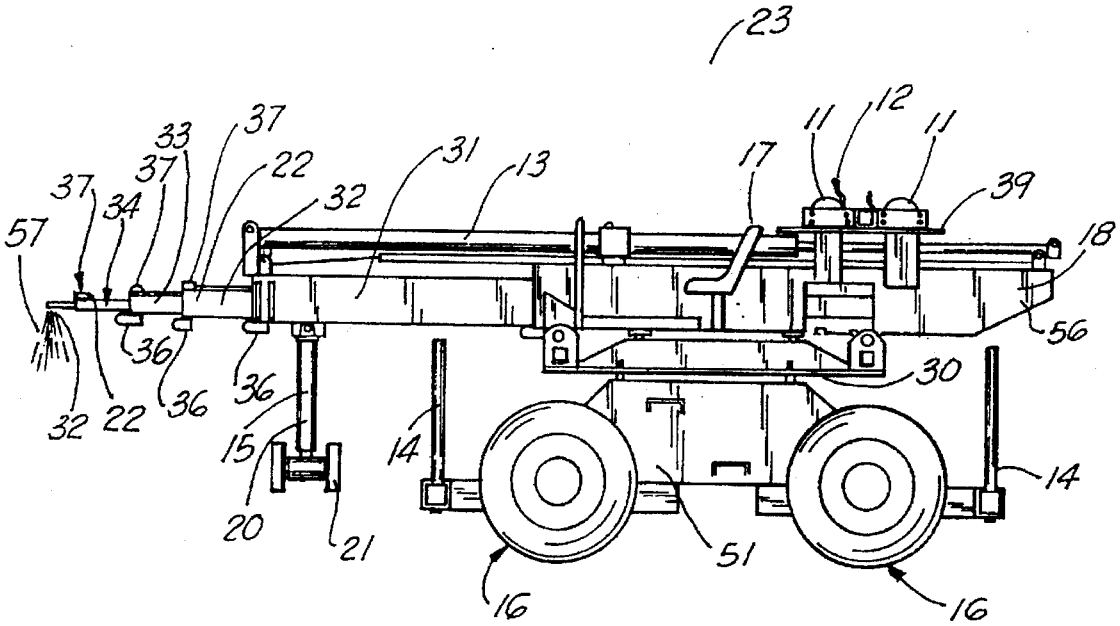
FIG. 1 shows a side view of the preferred embodiment of the instant invention.
Figure 2:
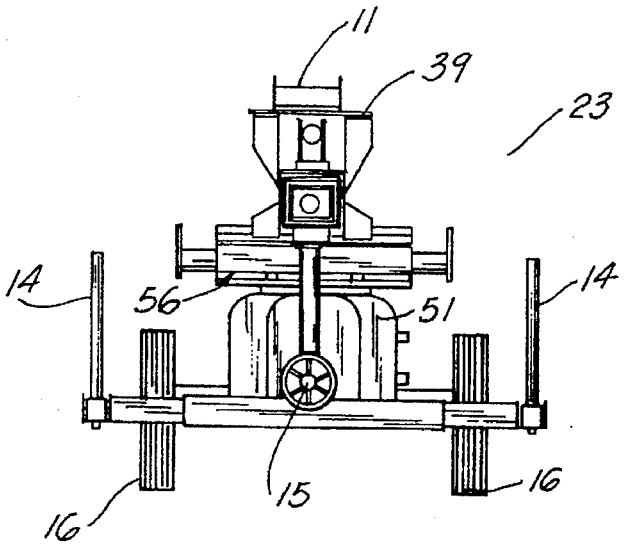
FIG. 2 shows a front view of the preferred embodiment of the instant invention.
Figure 3:
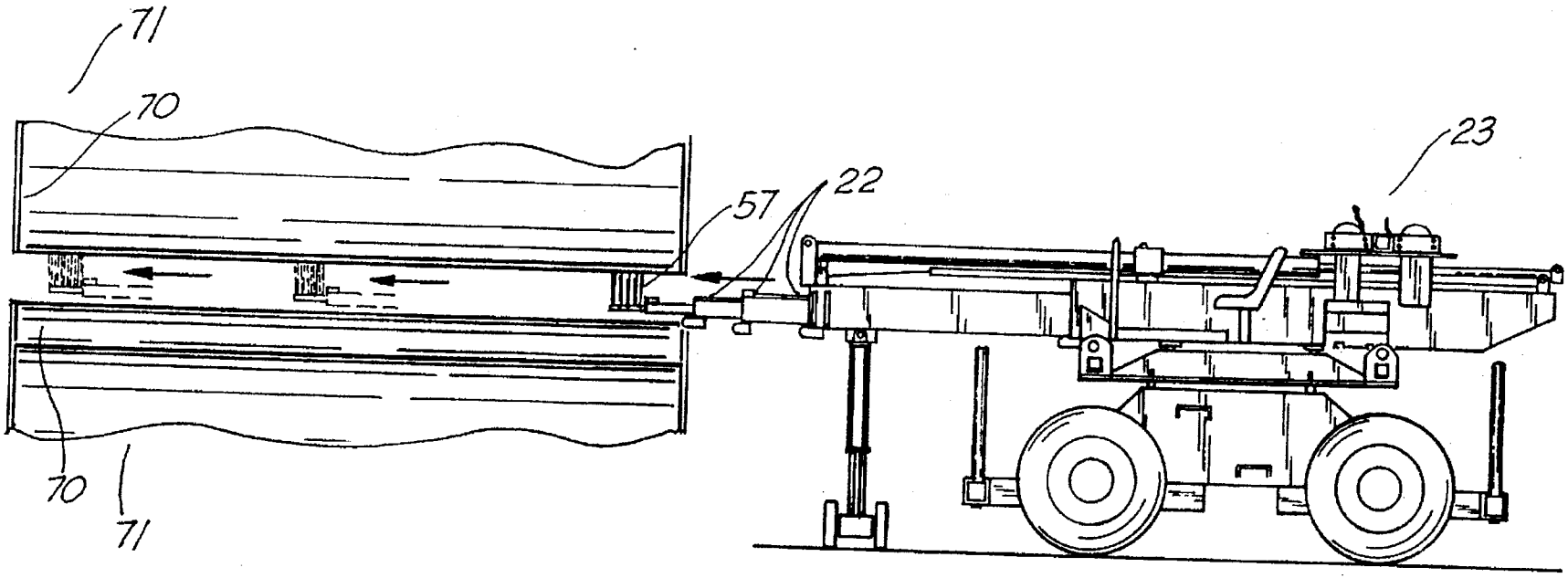
FIG. 3 shows a view of the preferred embodiment of the instant invention in use, with the extendable boom being extended between the rollers within a paper producing machine, with the embodiment of the invention show in side view and the paper producing machine shown in cross sectional, transverse view.
Figure 4:
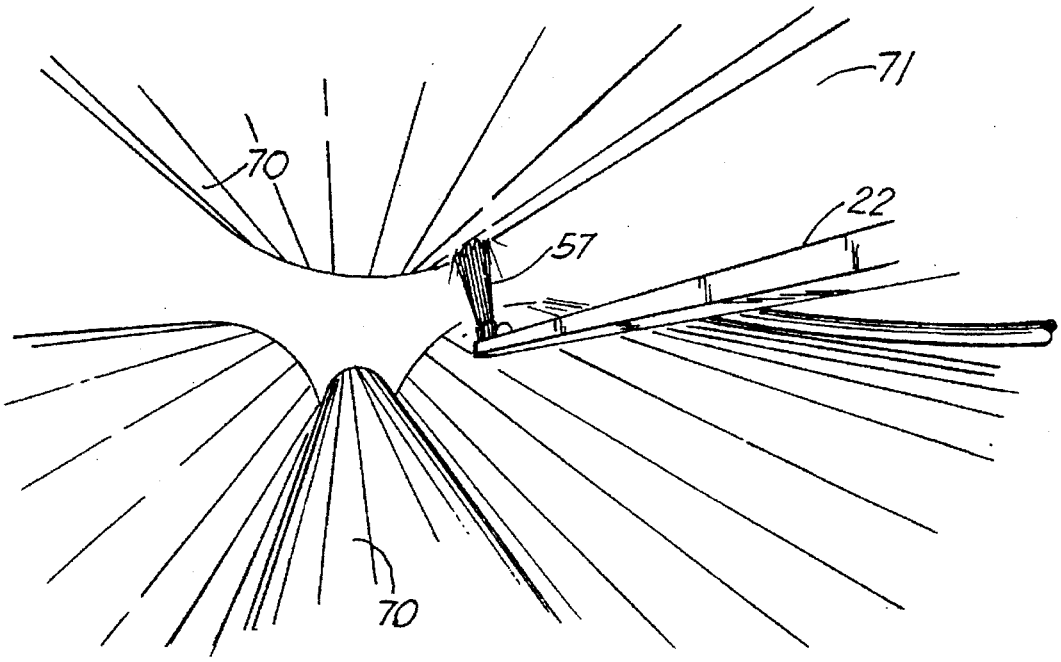
FIG. 4 is a close up view of within the paper machine segment show in FIG. 3.

FIGS. 1 and 2 show a side view, and a front view, respectively, of the preferred embodiment of the instant invention. Unlike the prior art, the instant invention provides for an extendible boom 22, extending from a movable and stablizable frame 56, wherein the boom is capable of accepting side spray loads. As shown in FIGS. 3 and 4, the boom 22 is extendable into a paper producing machine 71 where it can direct a high pressure cleaning, hydrospray 57 directly upon the face of the paper producing machine rollers 70, the high pressure spray being directed at an angle perpendicular to the axis of the boom 22, and the boom 22 being supported to accept the side load.

Further, the boom 22 is extendable and retractable into paper producing machine 71 so that it can be slowly inserted into a paper producing machine 71 along the face of a roller 70, where the directionally pointed spray 57 will wash the entire length of the roller 70 surface.

Further still, in an embodiment of the instant invention, there is further provided a separately positionable gear box drive unit 90 designed to engage with the roller turning mechanism 92 of the paper producing machine 71, such that the rollers 70 can be slowly turned. In combination, with the roller turning gear box drive unit 90 slowly rotating the rollers 70, and the boom 22 slowing extending and contracting along the length of the roller 70, the entire surface of the roller 70 can be cleaned without the need to remove the roller from the machine.

More particularly, in a preferred embodiment of the instant invention, the machine 23 has a motorized lower frame 51 with hydraulic outrigger support legs 14 and hydraulic boom support 20 which can stabilize the lower frame 51 and hold it in a rigid position with respect to the paper machine 71. The machine 23 is thus mobile, yet positionable and stablizable such that, in a paper manufacturing factory, the machine 23 can traverse the aisles between adjacent paper machines 71 and position itself along side the rolls 70 such that it can clean them with, inter alia, boom 22.

Boom 22 is composed of a telescoping rigid frame tube in four sections, 31–34 respectively, having a rectangular aspect and stiffened so as to resist motion, vibration or side thrust from directional hydrospray 57 from nozzles 52. Hydrospray nozzles 52 are located at the proximal end of boom 22 and are directed so as to spray directly upon the surface of rollers 70, thus, the emitted hydrospray 57 having a direction at about a right angle to the axis of boom 22.

In use the apparatus of the preferred embodiment is used by driving the machine 23 alongside the paper machine 71 until the telescoping boom 22 is positioned so that it can extend between adjacent rolls 70, as shown in FIGS. 3 and 4. The machine 23 is then stabilized by hydraulic supports 14 and 15. Next, the boom 22 is then extended into the paper producing machine 71 and high pressure water from hydrospray 57 nozzles 52 is directed at the outer surface of rollers 70, while such rollers remain in situ in paper producing machine 71.

In a preferred embodiment, the machine rollers 70 are then rotated slowly by means of a gear-driven gear box drive unit 90 while the telescoping boom 22 traverses from one end of the roller 70 to the other. At the end of a traversal when the outer surface of roller 70 is cleaned, in a preferred embodiment, the nozzles 52 are then switched to the opposite side of boom 22, relative to the rollers, in order to clean the rollers 70 opposite the ones just cleaned. The process is then repeated for the next opposite roller and so on until all rollers in a paper producing machine have been so cleaned.

More particularly, in a preferred embodiment, hydraulic wenches 11, located upon wench support 39, provide power to move and position the boom 22, under the control of control levers 12. This important feature allows easy positioning of the boom during both positioning of the machine 23 and use of the machine. Hydraulic outriggers 14 stabilize the machine 23, including both lower frame 51 and upper frame 56. It is an important feature of the instant invention that boom 22 is stabilized against the net side thrust caused by the use of hydrospray 57. Hydraulic outriggers 14 provide important anchoring and stabilization to the machine 23, and ultimately aid in stabilizing boom 22 against side thrusts, by inter alia, stabilizing the both the lower frame 51 and the upper frame 56.

Further important boom support is provided by boom support 15. Boom support 15, including hydraulic cylinder 20 and dolly wheels 21, support boom 22, including, but not limited to first stage of boom 31. Again, like the hydraulic outriggers 14, hydraulic cylinder 20 and dolly wheels 21 provide important support to boom 22 by allowing the boom to, inter alia, resist the net side thrust caused by the directional use of hydrospray 57. Tires 16 both provide further support and stabilization to the machine 23 including the boom 22, and also allow maneuverability of the machine.

Top support boom 13 further provides support to boom 22, to support the boom 22 against side stress, including against side thrust caused by the use of directional hydrospray 57.

In a preferred embodiment, via tires 16, a worker is able to sit upon seat 17 and not only operate the machine 23 in the cleaning of rollers 70, but in addition, maneuver and position the machine 23 along side paper producing machine 71 so that boom 22 can clean the rollers 70 in situ. Hand rotatable swivel positioned 30 allows easy positioning of boom 22 via hand rotation of upper frame 56 from 0° to 180° relative to the lower frame 51. This provides for easy positioning to allow boom 22 to enter paper producing machines 71 in order to clean paper manufacturing machine rollers 70 in situ.

Boom 22, consisting of, inter alia, first stage, second stage, third stage and fourth stage of boom, 31–34 respectively, sequentially extend outward in a telescoping fashion from upper frame 56, thereby allowing boom 22 to extend outward distally from upper frame 56. Each section of boom 22 (first stage 31 though fourth stage 34) provides further rigid support to boom 22. This support importantly provides resistance to boom 22 to vibration, shaking, other stresses and significantly, provides support for boom 22 against the net sideward thrust generated by the operation of directional hydronozzles 52 and production of directional hydrospray 57 at the distal end of boom 22. Further, lower guides 36 and upper guides 37, provide additional support to boom 22 and provide guidance for the telescoping boom portions.

In a preferred embodiment of the instant invention, hydroblaster nozzle fitting 52, which provides directional hydrospray 57, is located at or near end of boom 22 as shown in FIG. 3. FIG. 3 also shows the use of a preferred embodiment wherein telescoping boom 22 is extended into the space between paper machine rollers 70, which are in situ in paper machine 71. FIG. 3 also depicts a use of the preferred embodiment wherein boom 22 is extended into paper machine 71 and hydrospray 57 directionally cleans roller 70 as the boom traverses the length of the rollers 70. Note that boom 22 is supported against the net side thrust caused by the use of hydrospray 57.

FIG. 4 is a close up view of a segment of FIG. 3 and depicts a close up view of hydrospray 57 being directed at the surface of machine roller 70, located in situ within paper machine 71.

In still another preferred embodiment of the instant invention, the use of the machine 23 is combined with the use of a separate device 90, a gear box drive unit. Gear box drive unit 90 is separately attachable to paper producing machine 71 and is used to slowly turn the roller 70 while it is being cleaned by boom 22. Gear box drive unit 90 can be turned by a separate motor, such as an electronic or hydraulic motor. In concert, the use of machine 23 and gear box drive unit 90, the entire surface of the roller 70 can be cleaned while the roller remains in situ within the paper producing machine 71. In a preferred embodiment the result of total cleaning of outer surface of the roller 70 is achieved because gear box drive unit 90 is engaged via crank 91 to the roller turning mechanism of paper producing machine 71. Hence, in a preferred embodiment, gear box drive unit 90 can slowly turn the roller 70 within the paper producing machine 71 at the same time that boom 22 of machine 23 slowly extends along the outer surface of roller 70, traversing the surface of the roller from one end to the other. By the combination of turning the roller 70 and the traversal of boom 22 with hydrospray 57, the entire outer surface of the roller 70 can be cleaned by the instant invention without the need to ever remove the roller 70 from the paper producing machine 71.

Figure 5:
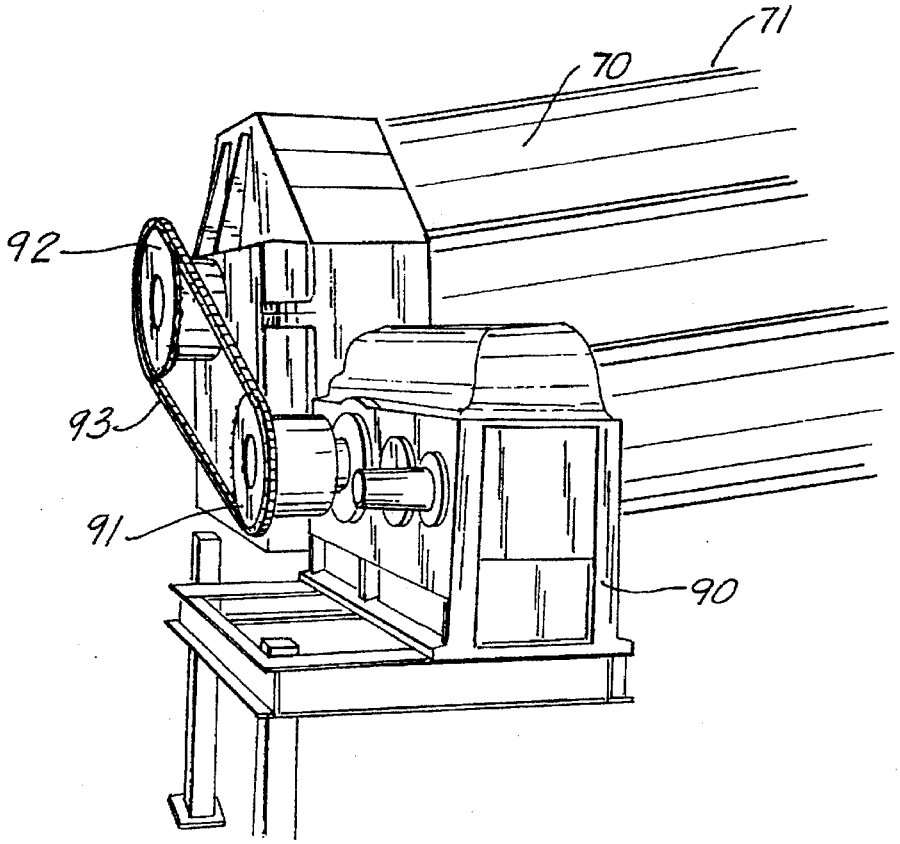
FIG. 5 shows a side view of a preferred embodiment of the instant invention in use, showing the machine rollers being slowly rotated during cleaning by means of a gear box drive unit separately engaged with the paper producing machine.

As shown in FIG. 5, in a preferred embodiment crank 91 located upon gear box drive unit 90 is engaged with roller turning mechanism 92 on paper producing machine 71 via a chain 93, thus allowing gear box drive unit 90 to slowly turn roller 70 while it is being cleaned.

The following table lists the part numbers and part descriptions as used herein and in the drawings attached hereto.

PARTS LIST

| Description | Part No. |
|---|---|
| hydraulic wench | 11 |
| control levers | 12 |
| top support boom | 13 |
| hydraulic outrigger | 14 |
| boom support | 15 |
| tires | 16 |
| seat | 17 |
| hydraulic cylinder/boom support | 20 |
| dolly wheels | 21 |
| boom | 22 |
| machine | 23 |
| and rotatable swivel positioned | 30 |
| first stage of boom | 31 |
| second stage of boom | 32 |
| third stage of boom | 33 |
| fourth stage of boom | 34 |
| lower guides | 36 |
| upper guides | 37 |
| wench support | 39 |
| lower frame | 51 |
| hydrospray nozzle | 52 |
| upper frame | 56 |
| directional hydrospray | 57 |
| paper machine rollers | 70 |
| paper machine | 71 |
| gear box drive unit | 90 |
| crank | 91 |
| roller turning mechanism | 92 |
| chain | 93 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A roller cleaning machine for cleaning paper producing machine rollers, while such rollers are in place within the paper producing machine, including:

a mobile lower base;

an upper base, supported by said lower base, and pivotable with respect to said lower base;

an extendable and retractable boom, attached to, and extendable outward from and retractable to said upper base;

a hydronozzle positioned near a distal end of said boom for providing a high-pressure spray directed away from said boom in the direction of said machine rollers, and at substantially a right angle to the axis of said boom;

said extendable and retractable boom further comprising a first stage, a second stage, a third stage and a fourth stage, each said stage sequentially extending outward in a telescoping fashion from said upper base, thereby allowing said boom to extend outward distally from said upper base, each said first stage, second stage, third and fourth stage of said boom being rigid thereby providing rigid support to said extendable and retractable boom thereby providing resistance to said boom to vibration, shaking, other stresses and further providing support for said boom against the net sideward thrust generated by the operation of said hydronozzle near said distal end of said boom;

lower guides and upper guides along said extendable and retractable boom, said lower guides and upper guides further providing support to said boom against vibration, shaking, other stresses and against the net sideward thrust generated by the operation of said hydronozzle near said distal end of said boom, and said lower guides and upper guides further providing guidance for said telescoping of said boom stages; and an adjustable boom support for supporting and stabilizing said extendable and retractable boom against vibration, shaking, other stresses and against the net sideward thrust generated by the operation of said hydronozzle near said distal end of said boom said boom support being connected to said boom and adjustably extending downward toward a ground surface for adjustably connecting said boom with the ground surface, said boom support further comprising a hydraulic cylinder and dolly wheels, said hydraulic cylinder providing a means for adjusting said boom support and said dolly wheels providing a means of connecting said boom support to the ground surface for stabilizing said boom against side forces from the operation of said hydronozzle.

2. The roller cleaning machine in claim 1, wherein the lower base is positionable and stablizable during use.

3. The roller cleaning machine in claim 1, further comprising a gear box drive unit positionable and stablizable relative to the paper producing machine, said gear box drive unit further comprising a crank that is engagable, via a chain, with gears of the paper producing machine such that said gear box drive unit can turn the rollers of the paper producing machine in situ during the cleaning process.

4. The roller cleaning machine in claim 1, wherein said boom is pivotal with said upper base.

5. A roller cleaning machine for cleaning paper producing machine rollers, while such rollers are in place within the paper producing machine, including:

a mobile, positionable and stablizable lower base positionable relative to the point of access to the rollers within a paper producing machine;

an upper base, supported by said lower base, and pivotable and adjustable relative to the point of access to the rollers within a paper producing machine;

an outwardly extending extendable and retractable boom, attached to, and pivotable with said upper base;

said boom extendable outward from and retractable to said upper base with a distal end directed into a paper producing machine from the point of access to the rollers within the machine;

a hydronozzle positioned near the distal end of said boom for providing a high-pressure spray directed away from said boom in the direction of the machine rollers to be cleaned;

said extendable and retractable boom further comprising a first stage, a second stage, a third stage and a fourth stage, each said stage sequentially extending outward in a telescoping fashion from said upper base, thereby allowing said boom to extend outward distally from said upper base, each said first stage, second stage, third and fourth stage of said boom being rigid thereby providing rigid support to said extendable and retractable boom thereby providing resistance to said boom to vibration, shaking, other stresses and further providing support for said boom against the net sideward thrust generated by the operation of said hydronozzle near said distal end of said boom;

lower guides and upper guides along said extendable and retractable boom, said lower guides and upper guides further providing support to said boom against vibration, shaking, other stresses and against the net sideward thrust generated by the operation of said hydronozzle near said distal end of said boom, and said lower guides and upper guides further providing guidance for said telescoping of said boom stages; and an adjustable boom support for supporting and stabilizing said extendable and retractable boom against vibration, shaking, other stresses and against the net sideward thrust generated by the operation of said hydronozzle near said distal end of said boom said boom support being connected to said boom and adjustably extending downward toward a ground surface for adjustably connecting said boom with the ground surface, said boom support further comprising a hydraulic cylinder and dolly wheels, said hydraulic cylinder providing a means for adjusting said boom support and said dolly wheels providing a means of connecting said boom support to the ground surface for stabilizing said boom against side forces from the operation of said hydronozzle.

6. The roller cleaning machine in claim 5, wherein the lower base is positionable and stablizable during use.

7. The roller cleaning machine in claim 5, further comprising a gear box drive unit positionable and stablizable relative to the paper producing machine, said gear box drive unit further comprising a crank that is engagable, via a chain, with gears of the paper producing machine such that said gear box drive unit can turn the rollers of the paper producing machine in situ during the cleaning process.

8. The roller cleaning machine in claim 5, wherein said boom is pivotal with said upper base.

9. A roller cleaning machine for cleaning paper producing machine rollers, while such rollers are in place within the paper producing machine, including:

a mobile, positionable and stablizable lower base positionable relative to the point of access to the rollers within a paper producing machine;

a pivotable upper base, supported by said lower base, and pivotable with respect to said lower base, said upper base pivotable and adjustable relative to the point of access to the rollers within a paper producing machine;

an outwardly extending extendable and retractable boom, attached to, and pivotable with said upper base, said boom extendable outward from and retractable to said upper base along substantially the entire length of a roller within a paper producing machine from the point of access to the rollers within the machine;

a hydronozzle positioned near the distal end of said boom to provide a high-pressure spray directed away from said boom at about a right angle to the axis of said boom;

a gear box drive unit positionable and stablizable relative to gears of the paper producing machine for turning the rollers of the paper producing machine while said boom extends the entire length of the roller, such that the entire outer surface of the roller is cleaned as the high pressure spray is directed toward the roller;

said extendable and retractable boom further comprising a first stage, a second stage, a third stage and a fourth stage, each said stage sequentially extending outward in a telescoping fashion from said upper base, thereby allowing said boom to extend outward distally from said upper base, each said first stage, second stage, third and fourth stage of said boom being rigid thereby providing rigid support to said extendable and retractable boom thereby providing resistance to said boom to vibration, shaking, other stresses and further providing support for said boom against the net sideward thrust generated by the operation of said hydronozzle near said distal end of said boom;

lower guides and upper guides along said extendable and retractable boom, said lower guides and upper guides further providing support to said boom against vibration, shaking, other stresses and against the net sideward thrust generated by the operation of said hydronozzle near said distal end of said boom, and said lower guides and upper guides further providing guidance for said telescoping of said boom stages;

said gear box drive unit further comprising a crank that is engagable, via a chain, with gears of the paper producing machine such that said gear box drive unit can turn the rollers of the paper producing machine in situ during the cleaning process; and an adjustable boom support for supporting and stabilizing said extendable and retractable boom against vibration, shaking, other stresses and against the net sideward thrust generated by the operation of said hydronozzle near said distal end of said boom said boom support being connected to said boom and adjustably extending downward toward a ground surface for adjustably connecting said boom with the ground surface, said boom support further comprising a hydraulic cylinder and dolly wheels, said hydraulic cylinder providing a means for adjusting said boom support and said dolly wheels providing a means of connecting said boom support to the ground surface for stabilizing said boom against side forces from the operation of said hydronozzle.

10. The roller cleaning machine in claim 9, wherein the lower base is positionable and stablizable during use.

11. The roller cleaning machine in claim 9, wherein said boom is pivotal with said upper base.

* * * * *